US008302970B2

(12) United States Patent
Montano

(10) Patent No.: US 8,302,970 B2
(45) Date of Patent: Nov. 6, 2012

(54) INTERACTIVE GAMING APPARATUS

(76) Inventor: Joseph Montano, Glastonbury, CT (US)

( * ) Notice: Subject to any disclaimer, the term of this patent is extended or adjusted under 35 U.S.C. 154(b) by 47 days.

(21) Appl. No.: 13/024,363

(22) Filed: Feb. 10, 2011

(65) Prior Publication Data

US 2012/0205869 A1 Aug. 16, 2012

(51) Int. Cl.
*A63F 9/00* (2006.01)
*A63F 1/14* (2006.01)

(52) U.S. Cl. ..... 273/292; 273/149 R; 273/148 R

(58) Field of Classification Search ..... 273/292, 273/148 R, 149 R
See application file for complete search history.

(56) References Cited

U.S. PATENT DOCUMENTS 1,514,823 A * 11/1924 Austin ..... 434/129
2,593,631 A * 4/1952 Tognetti ..... 273/269
3,817,530 A * 6/1974 Howard ..... 273/281
5,695,189 A * 12/1997 Breeding et al. ..... 273/149 R
6,361,044 B1 * 3/2002 Block et al. ..... 273/149 R
6,543,770 B1 * 4/2003 Kaji et al. ..... 273/148 R
7,510,186 B2 * 3/2009 Fleckenstein ..... 273/149 R

* cited by examiner

*Primary Examiner* — Michael Dennis
(74) *Attorney, Agent, or Firm* — Kelly Merkel, Esq.

(57) ABSTRACT

An interactive gaming apparatus for participation in a card-style game includes a stationary gaming surface having a channel defined therethrough. The channel establishes a travel path for a roller chain driven by rotatable drive shafts and thereby translating movement to a bandolier. The bandolier includes a plurality of card inserts with slots that accommodate insertion of a card tile therein such that any card tile is interchangeable in any card inert slot. Movement of the bandolier thereby conveys likewise movement to card tiles retained by the card insert slots relative to the gaming surface. The gaming surface further includes a continuous groove and one or more linear grooves defined therein. One or more chip members are slidable along the continuous and linear grooves to provide players with player and dealer designation or to designate various betting amounts available to each player.

17 Claims, 5 Drawing Sheets

INTERACTIVE GAMING APPARATUS

FIELD OF THE INVENTION

The present invention is directed to an interactive gaming apparatus played among two or more players. In particular, the present invention is directed to an apparatus for a poker-style game having movable cards translated horizontally along a gaming surface to enable a desired card draw.

BACKGROUND OF THE INVENTION

Many poker and poker-style games are known that involve players to form certain card combinations or hands (for example, flushes, straights, pairs, etc.) to beat other players' hands. Popular variants of such poker games proceed according to one or more of the rules of poker, including but not limited to rules from Texas Hold'em, Draw Poker, Seven-Card Stud Poker, Omaha, or any other version of poker. For example, in hold'em-style games, players must form the best poker hand from the combination of a subset of cards that are dealt face down and private to each player, and a group of community cards that are face up and available to all players. In some embodiments, a dealer may be present, and that dealer may also be a participant in the game. The dealer may represent the house (such as a casino) or himself, and the dealer may perform a variety of tasks such as dealing cards, enforcing game rules, collecting and distributing money and performing any other functions. The dealer may be human, mechanical, or electronic (i.e., in a game played over a network, the dealer may be simulated by a program).

Although scores of electronic poker devices exist that employ electronic dealers, such devices require complex electronics and maintenance not only for individual game operators but also for subscribers to any network over which interactive gaming is effected. For individuals wishing to participate in multi-player poker games, and for many establishments where gaming and entertainment devices must render superior entertainment at minimal cost, mechanical poker games provide reliable operation without sacrificing entertaining value. Prior mechanical poker games, however, limit the interaction of the dealer with other players and often limit the variances in different poker styles that can be played even within the same round of betting.

Accordingly, what is needed is a live table game that incorporates the efficiencies of mechanical dealers yet preserves the desirable one-on-one interaction of human dealers. Such a table game can be realized in a mechanical apparatus that preserves the statistical nature of the deal while enabling the dealer to be a full participant in the game.

SUMMARY OF THE INVENTION

According to an aspect of the present invention, an interactive gaming apparatus allows participation in a card-style game by at least one player. The gaming apparatus includes a stationary gaming surface having a top surface, a bottom surface and a peripheral edge defining a predetermined thickness. A channel is defined through the gaming surface that delineates a travel path intermediate a pair of opposed channel extents. A drive means, such as a roller chain, is in operable communication with the gaming surface along the travel path intermediate the channel extents. A bandolier in operable communication with the drive means has at least one card insert releasably connected thereto such that the drive means translates movement to the card insert. Each card insert includes a top surface having a slot for retention of at least one card tile thereby and a bottom surface for releasable attachment with the drive means. At least one card tile is provided in correspondence to each card insert such that movement translated to the card inserts of the bandolier is realized by the card tiles retained in the slots. Bandolier remains in continuous movement relative to the gaming surface throughout participation in a game as card tiles are retrieved from and reinserted into the card insert slots.

The gaming surface of the present invention gaming apparatus further includes a continuous groove and one or more linear grooves defined within the top surface thereof. The linear grooves may be distributed in series along the gaming surface or provided in one or more groups for play attributable to a designated player or team of players. At least one chip member is slidable along at least one of the continuous groove and the linear grooves. The chip member includes an essentially planar portion having a top surface, a bottom surface and a peripheral edge defining a thickness therebetween. The chip member further includes a retention element protruding from the bottom surface thereof for slidably releasable engagement with at least one of the continuous groove and the linear grooves. The chip member can represent a variety of betting amounts or other designations that are easily transferred among players along the grooves.

BRIEF DESCRIPTION OF THE DRAWINGS

The various embodiments of the present invention will now be described in detail with respect to preferred embodiments thereof, which are to be taken together with the accompanying drawings, in which.

DETAILED DESCRIPTION OF THE INVENTION

Figure 1:
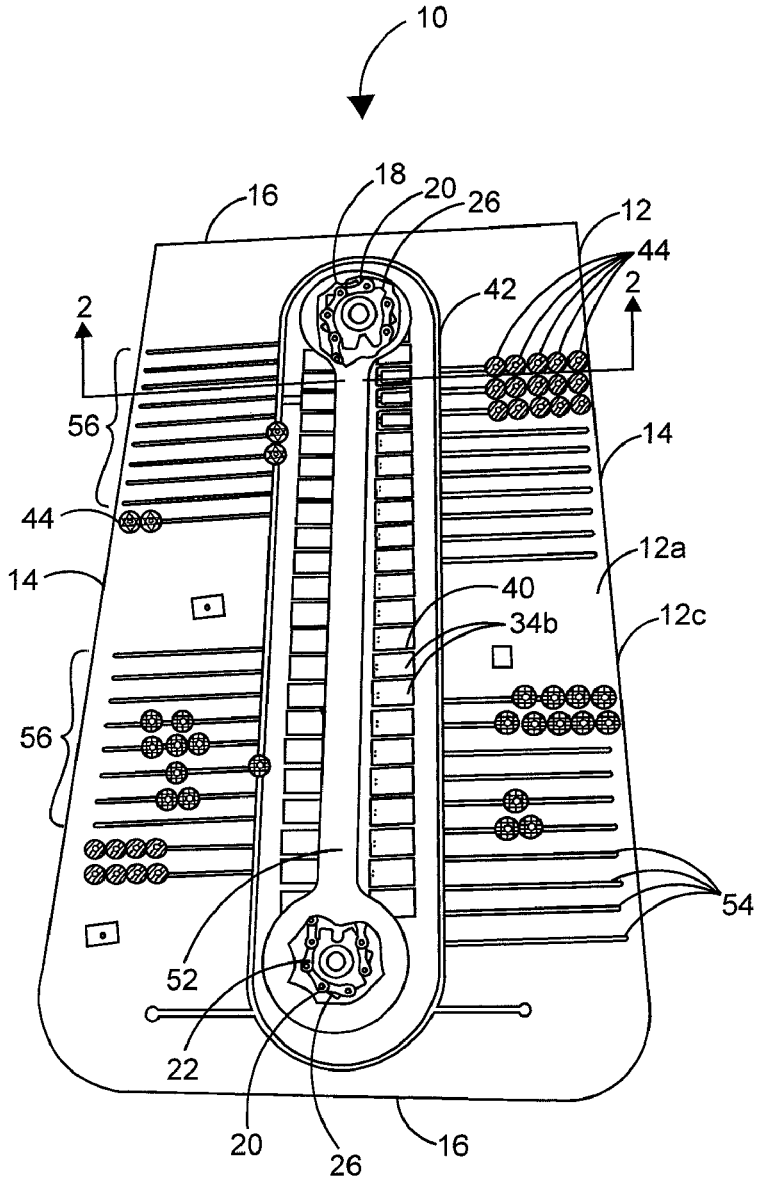
FIG. 1 is a top perspective view of an interactive gaming apparatus of the present invention.
Figure 2:
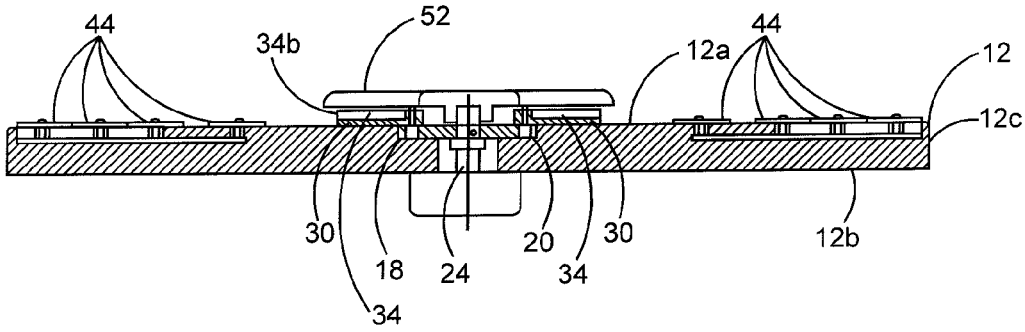
FIG. 2 is a sectional view of the interactive gaming apparatus of FIG. 1 along line 2-2.

Now referring to the figures, wherein like numbers represent like elements, FIGS. 1 and 2 disclose an interactive gaming apparatus 10 for a card game. Although gaming apparatus 10 is shown and described herein with respect to a poker-style game, it is understood that the gaming apparatus can be customized to accommodate any type of card-style game, including but not limited to pinochle, hearts, gin, bridge and the like.

Gaming apparatus 10 includes a generally planar, stationary gaming surface 12 having a top surface 12*a*, a bottom surface 12*b* and a peripheral edge 12*c* defining a predetermined thickness thereby. Peripheral edge 12*c* defines a peripheral extent of gaming surface 12, which is illustrated herein to assume a generally rectangular geometry having elongate sides 14 and truncated sides 16. It is understood, however, that other geometries may be adapted in accordance with the present invention without departing from the scope thereof.

Figure 3:
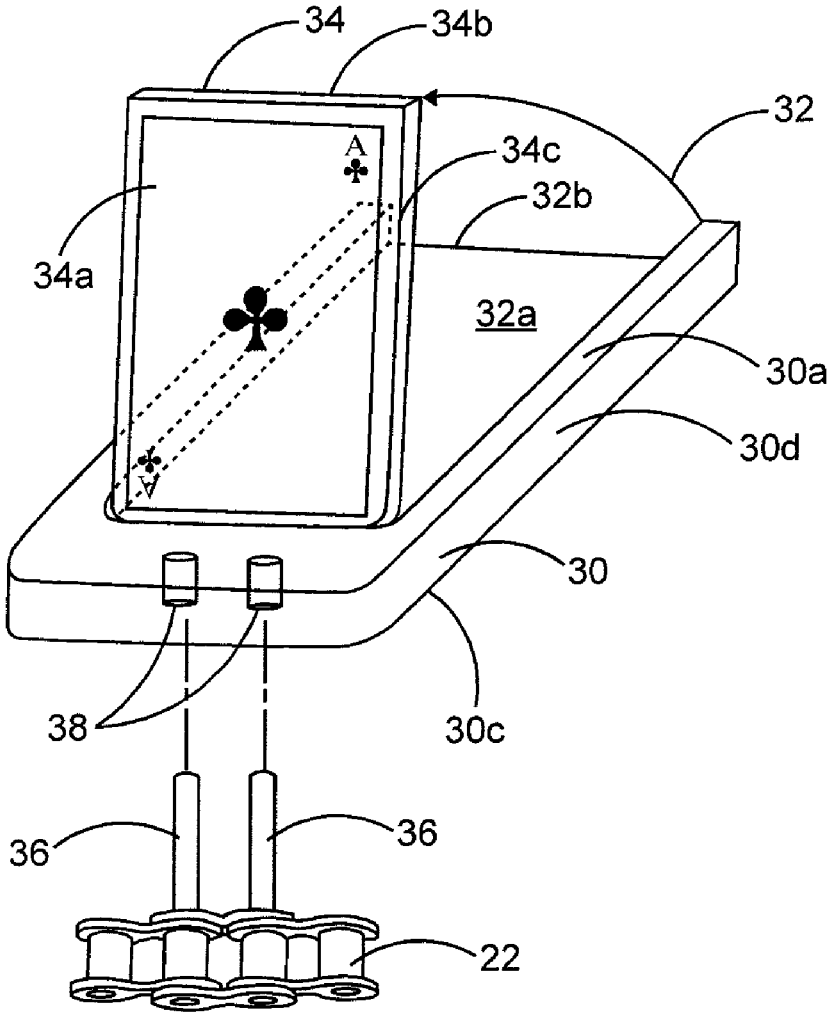
FIG. 3 is a front perspective view of an individual card and receptacle used with the interactive gaming apparatus of the present invention.

A channel 18 is defined through gaming surface 12 so as to accommodate continuous operation of a drive means relative to the stationary gaming surface. An exemplary drive means is provided herein as a roller chain 20 having a plurality of interconnected links 22 (a single link 22 is shown in FIG. 3). Roller chain 20 may be a single pitch, double pitch or multiple pitch chain configurations as is known in the art. A rotatable drive shaft 24 is operably disposed at a corresponding extent 26 of channel 18 wherein opposed extents 26 establish the appropriate center distances for uninterrupted operation of roller chain 20. Power is transferred to drive shafts 24 by known actuation means, such as a servo motor (not shown) that may be controlled by a programmable microcomputer. Channel 18 provides an uninterrupted travel path for conveyance of roller chain 20 between extents 26 relative to gaming surface 12.

Now referring to FIG. 3, each link 22 of roller chain 20 conveys a corresponding card insert 30 thereby. Each card insert 30 includes a top surface 30*a* defining a slot 32 with a support surface 32*a* therein and a card tile ingress 30*b* for retention of at least one card tile 34. Each card insert 30 further includes a bottom surface 30*c* for releasable attachment of the card insert with a corresponding link 22 and a peripheral edge 30*d* defining a predetermined thickness and geometry such that each card tile 34 is interchangeably retained by any corresponding slot 32. Each card insert 30 is detachably affixed to a corresponding link via appropriate attachment means such as protrusions 36 depending upwardly from each link 22 for frictional engagement by corresponding recesses 38 defined along bottom surface 30*c* of each card insert 30. It is understood that other equivalent attachment means may be employed without departing from the scope of the invention, such as interlocking notches and grooves, snap-tight engagement and equivalent mechanical attachment means.

A plurality of card inserts 30 is provided in general correspondence with a predetermined number of card tiles 34 so as to form a bandolier 40 of card inserts 30 in series. Bandolier 40 is correspondingly movable relative to gaming surface 12 as drive shafts 24 move roller chain 20 along travel path 28. Thus, as roller chain 20 conveys each card insert 30 along gaming surface 12, card tiles 34 placed in corresponding slots 32 of card inserts 30 are likewise conveyed to provide a continuous deal.

Card tiles 34 are representative of playing cards in a standard deck. Although there are many types of playing cards that are played in many different types of games, gaming apparatus 10 contemplates incorporation of a standard 52-card deck divided out into four different suits (such as Spades, Hearts, Diamonds and Clubs). Each card tile 34 includes a face 34*a* on which each suit is indicated, a back 34*b* which hides the suit from other players (and may have one or more aesthetic designs provided thereon) and a peripheral edge 34*c* defining a predetermined thickness for interchangeable insertion of any card tile 34 into any slot 32. In the standard deck, each of the four suits of cards consists of 13 cards, numbered either two through ten, or lettered A (Ace), K (King), Q (Queen), or J (Jack), which is also printed or indicated on the face of each card. In some cases, a predetermined number of extra cards such as "Joker" cards may be included, depending on the particular game being played.

Figure 4:
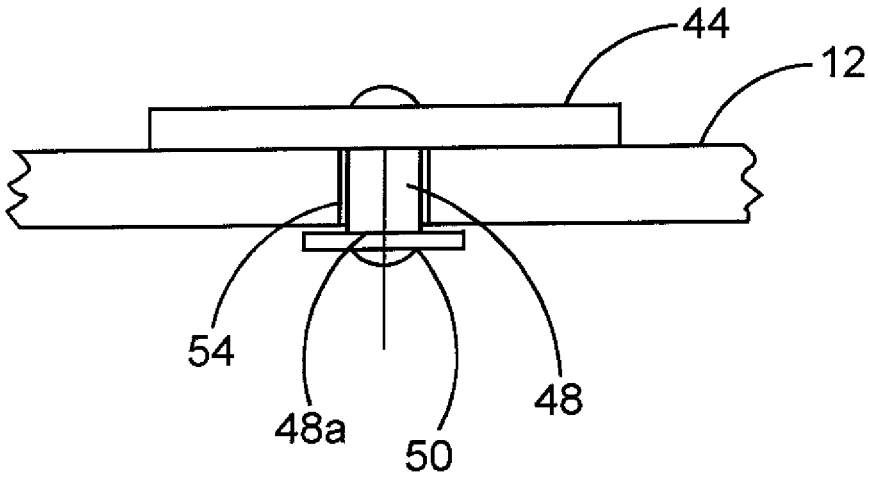
FIG. 4 is a partial sectional view of a gaming surface of the interactive gaming apparatus of the present invention having a chip retained thereby.
Figure 5:
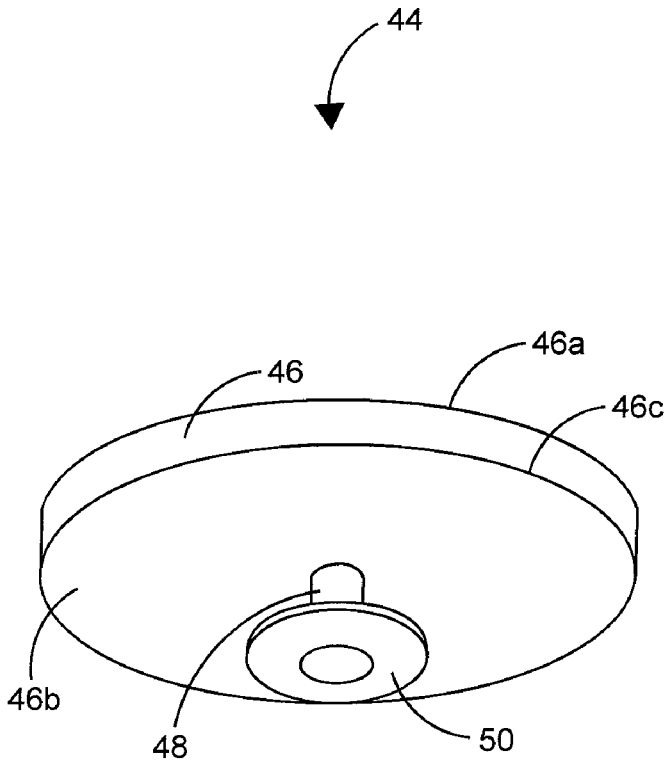
FIG. 5 is a bottom perspective view of an exemplary chip used with the interactive gaming apparatus of FIG. 1.

Referring further to FIGS. 3, 4 and 5, gaming surface 12 further includes a continuous groove 42 defined within top surface 12*a* that accommodates slidable engagement of at least one chip member 44 therealong. Referring further to FIGS. 4 and 5, a chip member 44 has an essentially planar portion 46 having a top surface 46*a*, a bottom surface 46*b* and a peripheral edge 46*c* defining a thickness therebetween. A retention element 48 protrudes generally normally from bottom surface 46*b* of planar portion 46 to enable releasable engagement of chip member 44 with continuous groove 42. Retention element 48 has a free extent 48*a* at which a flange 50 may be defined to further ensure retention of chip member 44 by groove 42 as chip member 44 slides therealong relative to gaming surface 12. Chip member 44 may selectively include a player designation in accordance with a player's role in the game, such as "dealer", "small blind", "big blind" and the like. Chip member 44 may also incorporate one or more of a variety of geometries, colors and indicia such that betting amounts are represented by correspondingly "valued" chip members. Thus, each chip member can represent an established betting amount (for example, a $20 bet can be represented by a chip member having a specific color, shape and/or identifying indicia that all players recognize and accept as representing the $20 amount).

A platform 52 is selectively provided adjacent gaming surface 12 to provide a support surface upon which one or more card tiles 34 may be placed during a round of play, such as before or during a betting hand. Platform 52 may also support one or more chip members 44 to set aside predetermined betting amounts, depending on the game being played. Platform 52 may further support beverages, food and personal items thereon to enable easy reach thereof by each player without interference with gaming surface 12. Platform 52 aesthetically disguises roller chain 20 and drive shafts 24 so as to hide such actuating elements from view of the players.

Gaming surface 12 additionally includes a plurality of linear grooves 54 defined within top surface 12*a* so as to provide uninterrupted sliding movement of one or more chip members 44 between continuous groove 42 and one or more linear grooves 54. Linear grooves 54 can be evenly distributed in a series along gaming surface 12. Alternatively, linear grooves 54 can be distributed in one or more groups 56 as shown in FIG. 1, wherein each group 56 corresponds to at least one individual or team participant (regardless of whether a participant is a dealer or other player) to enable competition among single players and among teams of players. A player can slidably convey at least one chip member 44 between continuous groove 42 and at least one liner groove 54 to provide a visual depiction of a current bet and to transfer amounts from winning hands among participating players. In this manner, chip members 44 always remain slidably engaged with continuous groove 42 and one or more linear grooves 54 to ensure fair accounting of each winning hand and reliable transfer of winning amounts among players.

As an exemplary operation of gaming apparatus 10, the gaming apparatus is used for multiple players in a poker-style game. Card tiles 34 are "shuffled" (either manually or by powered shuffling means as is known in the art) and distributed into slots 32 of card inserts 30 such that faces 34*a* are disposed adjacent slot support surface 32*a*. Depending upon the game being played, not every slot needs to contain a card tile, although each slot having a card tile generally retains a single card tile thereby. As drive shafts 24 transfer motion to roller chain 20, roller chain 20 conveys movement to bandolier 40 such that card inserts 30 travel along travel path 28 relative to gaming surface 12.

A game participant is identified as the "dealer", and a chip member bearing the "Dealer" designation is slidably transposed along continuous groove 42 to a linear groove 54 to represent the player in the dealer position. As the dealer button rotates (for example, rotating clockwise after each hand), the dealer chip member is slidably transposed along linear groove 54 from the currently designated dealer to continuous groove 42, and thereafter slidably transposed along continuous groove 42 until it reaches a linear groove 54 corresponding to the next designated dealer. If minimum bets are enforced, the rotation of the dealer chip member accordingly changes the players required to post the small blind (a fraction of the minimum betting amount per hand) and the big blind (the minimum betting amount per hand). The players responsible for the small blind and the big blind can correspondingly have alternative chip members 44 slidably disposed in linear grooves 54 corresponding to the minimum betting amount for a particular hand.

The designated dealer deals two card tiles face down to each player by sliding card tiles 34 from slots 32 as bandolier 40 remains in continuous movement relative to gaming surface 12. Alternatively, the dealer can designate all players to select two cards face down as card tiles 34 move past each player. The hand begins with a "pre-flop" betting round, beginning with the player to the left of the big blind (or the player to the left of the dealer, if no blinds are used) and continuing clockwise. Each player retains one or more chip members 44 in linear grooves 54. A round of betting continues until every player has folded, put in all of their chip members 44 or matched the amount put in by all other active players. Betting amounts are represented by sliding correspondingly "valued" chip members along linear grooves 54 toward continuous groove 42 to indicate that the bet is active. Alternatively, matching bets can be represented by placing the appropriate number of chip members along platform 52, for example, if betting amounts are being borrowed among players.

After the pre-flop betting round, assuming there remain at least two players taking part in the hand, the dealer "deals" three face-up community cards (herein referred to as "the flop") by selecting three card tiles 34 from bandolier 40. The dealer does not need to select successive card tiles and can select card tiles from any available slot 32. The dealer places the community cards on platform 52 for inspection by all players such that each player can elect to slide one or more chip members 44 toward continuous groove 42 (or alternatively place selected chip members 44 on platform 52, depending on the game being played) to represent the respective player's betting amount. After the flop betting round ends, a single community card (herein referred to as the "turn") is dealt when the dealer selects another card tile 34 and places the selected card tile on platform with its face 34*a* visible to all players. A final single community card (herein referred to as "the river") is then dealt in the same manner. As bets are won and lost, players accordingly slide a number of chip members 44 corresponding to the amount to be transferred among players. Thus, a player having a losing bet will complete sliding movement of chip members 44 from linear grooves 54 to continuous groove 42 and thereafter slide the chip members along continuous groove until the chip members arrive at linear grooves 54 for the player having the winning bet. Throughout play, bandolier 40 continues movement of the cards relative to the gaming surface such that card tiles can be continuously re-inserted and "shuffled" to allow a more enhanced gaming experience.

The gaming apparatus of the present invention is amenable to a variety of card game variations. For example, games can be played in which player actions are fixed by game rules, or games may be played wherein the rules are selectively changed by the players after commencement of the game. The game can accommodate bets, antes, raises, calls, checks and folds as well as any rake determined to be collectable by the house. The gaming apparatus can further accommodate rotation of players among positions (for instance, movement of a player among groups 56 of linear grooves 54 to distinguish certain players as "high rollers" and other players as "novices"). Player designations are changeable, as are the game rules, along with the players' preferences to create gaming options outside of pre-established rules. In this manner, the present invention can enable players of all skill levels to participate as players and dealers while teaching strategies for playing a variety of poker and other card games.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An interactive gaming apparatus for participation in a card-style game by at least one player, comprising: a stationary gaming surface having a top surface, a bottom surface and a peripheral edge defining a predetermined thickness thereby; said gaming surface having a channel defined therethrough delineating a travel path, wherein said channel includes a pair of opposed extents; a drive means in operable communication with said gaming surface along said travel path intermediate said extents of said channel; a bandolier in operable communication with said drive means, said bandolier' having at least one card insert releasably connected to said drive means such that said drive mains translates movement to said at least one card insert relative to said gaming surface; each said at least one card insert including a top surface having a slot for retention of at least one card tile thereby; wherein each said at least one card insert further includes a bottom surface and a peripheral edge; at least one card tile corresponding to each said at least one card insert, each said at least one card tile being interchangeably receivable by said slot of said at least said at least one card insert such that said movement translated to said at least one card insert by said drive means translates corresponding movement to said at least one card tile; wherein said bandolier is correspondingly movable relative to said gaming surface as said drive means conveys said at least one card insert to enable said at least one player' to select said at least one tile in accordance with predetermined rules of said card-style game; wherein said drive means comprises a roller chain having at least one link in correspondence with said at least one card insert.

2. The interactive gaming apparatus of claim 1, wherein said drive means further comprises a rotatable drive shaft disposed at each extent of said channel so as to establish predetermined center distances for said roller chain.

3. The interactive gaming apparatus of claim 2, wherein an actuation means transfers power to at least one said rotatable drive shaft.

4. The interactive gaming apparatus of claim 1, wherein said at least one link is releasably attached to said at least one said card insert such that translation of movement to said roller chain effects corresponding movement to said bandolier.

5. The interactive gaming apparatus of claim 4, further including attachment means for effecting releasable attachment of said at least one link and said at least one card insert.

6. The interactive gaming apparatus of claim 5, wherein said attachment means comprises at least one protrusion depending from said at least one link for corresponding frictional with at least one recess defined along said bottom surface of said at least one card insert.

7. The interactive gaming apparatus of claim 1, wherein said gaming surface further includes a continuous groove defined within top said surface.

8. The interactive gaming apparatus of claim 7, wherein said gaming surface further includes one or more linear grooves defined within said top surface.

9. The interactive gaming apparatus of claim 8, wherein said one or more linear grooves are distributed in a series along said gaming surface.

10. The interactive gaming apparatus of claim 8, wherein said one or more linear grooves are distributed in one or more groups of linear grooves.

11. The interactive gaming apparatus of claim 8, further comprising at least one chip member slidable along at least one of said continuous groove and said one or more linear grooves.

12. The interactive gaming apparatus of claim 11, wherein said at least one chip member includes an essentially planar portion having a top surface, a bottom surface and a peripheral edge defining a thickness therebetween.

13. The interactive gaming apparatus of claim 12, wherein said at least one chip member further includes a retention element protruding from said bottom surface thereof for slidably releasable engagement of said at least one chip member with at least one of said continuous groove and said one or more linear grooves.

14. The interactive gaming apparatus of claim 13, wherein said retention element of said at least one chip member has a flange defined at a free extent thereof.

15. The interactive gaming apparatus of claim 1, wherein said bandolier includes a plurality of said card inserts provided in series.

16. The interactive gaming apparatus of claim 1, wherein said card tiles are representative of playing cards in a standard 52-card deck.

17. The interactive gaming apparatus of claim 1, further comprising a platform disposed adjacent said gaming surface so as to visually obstruct said drive means.

* * * * *